US006737803B2

(12) United States Patent
Slot et al.

(10) Patent No.: US 6,737,803 B2
(45) Date of Patent: May 18, 2004

(54) SAFETY SWITCH FOR AN ELECTRIC LAMP HAVING AN INNER BULB AND AN OUTER BULB

(75) Inventors: Steven Thomas Slot, Singapore (SG); Cornelis Versluijs, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/906,349

(22) Filed: Jul. 16, 2001

(65) Prior Publication Data

US 2002/0047517 A1 Apr. 25, 2002

(30) Foreign Application Priority Data

Jul. 17, 2000 (EP) ..... 00202563

(51) Int. Cl.[7] ..... H01K 1/26; H01K 1/42; H01J 13/46; H01J 17/34

(52) U.S. Cl. ..... 313/580; 315/73

(58) Field of Search ..... 313/580, 578, 313/25, 315, 316, 317, 318.12, 318.06, 573, 318.08, 318.09; 315/73; 361/120, 183, 112.54, 2; 439/181; 362/21

(56) References Cited

U.S. PATENT DOCUMENTS 1,068,836 A * 7/1913 Banick ..... 362/21
1,102,009 A * 6/1914 Csanyi ..... 362/21
4,013,919 A * 3/1977 Corbley ..... 315/73
4,195,251 A * 3/1980 Bamberg ..... 315/73
4,205,258 A * 5/1980 Ward ..... 315/73
4,305,020 A * 12/1981 Nalepa ..... 315/73
4,388,557 A * 6/1983 Shaffer ..... 315/74
4,973,881 A * 11/1990 Haraden et al. ..... 315/73
6,462,478 B1 * 10/2002 Oetken et al. ..... 315/73
6,570,327 B1 * 5/2003 Pinot et al. ..... 313/580

* cited by examiner

*Primary Examiner*—Sandra O'Shea
*Assistant Examiner*—Pete Macchiarolo
(74) *Attorney, Agent, or Firm*—Ernestine C. Bartlett

(57) ABSTRACT

An electric lamp (1) comprising a gastight lamp vessel (2) for the transformation of electrical energy into light, which lamp vessel has two current conductors (3,6; 4,7) which extend to the outside. The lamp further comprises an outer envelope (9) in which the lamp vessel (2) is arranged with a space between the lamp vessel and the outer envelope. The outer envelope (9) has a lamp cap (11) to which the current conductors (6,7) are electrically connected. The lamp (1) further has means (17) for switching off the lamp by short-circuiting the current conductors (6,7) in the case of fracture of the outer envelope (9).

9 Claims, 3 Drawing Sheets

SAFETY SWITCH FOR AN ELECTRIC LAMP HAVING AN INNER BULB AND AN OUTER BULB

BACKGROUND OF THE INVENTION

The invention relates to an electric lamp having a gastight inner bulb for converting electrical energy into light, the lamp also having an outer bulb surrounding and spaced apart from the inner bulb, the lamp also having a lamp cap connected to the outer bulb, and two current conductors extending from the inner bulb, carried by a support, and electrically connected to the lamp cap, the lamp also having means designed for switching off the lamp in the case of a defect of the outer bulb.

Such a lamp is known from U.S. Pat. No. 4,229,678 (Petro), the lamp being a high-pressure mercury vapor discharge lamp. Such lamps may form a safety risk if the outer bulb of the lamp breaks while the lamp continues burning. In such a case, in fact, there is the particular risk that the high temperature and high pressure inside the inner bulb will cause the latter to break as well, so that hot substances are released into the atmosphere, with all the possible disadvantages this involves for any persons and objects that happen to be in the vicinity. Petro proposes a solution for this problem by providing a switch for switching off the lamp if the outer bulb should inadvertently be fractured. This switch is present in the top inside the outer bulb, connected in series in the electrical circuit of the lamp. The switch comprises an electrically conducting element which under normal circumstances bears under spring pressure on the inner surface of the outer bulb and which springs outward upon a fracture of the outer bulb, thus breaking the electrical circuit in the lamp. Switching-off of the known lamp in the case of an outer bulb fracture accordingly takes place through interruption of the electrical circuit inside the lamp.

A disadvantage of this solution is that the switch used therein gives the lamp an unattractive appearance, while furthermore there is an undesirable optical disturbance because the switch forms an optical barrier for the light issuing from the inner bulb to the exterior. A further disadvantage of the known lamp is that mounting of the switch is cumbersome and expensive in mass manufacture, which renders this lamp uninteresting from an economic point of view.

OBJECTS AND SUMMARY OF THE INVENTION

It is an object of the invention to counteract the disadvantages of the prior art indicated above, by providing means for extinguishing an electric lamp upon the ocurrence of a defect (for example, a fracture) of the outer bulb, in a simple, elegant, and accordingly economically responsible manner, without any undesirable optical side effects.

According to the invention, an electric lamp of the kind mentioned in the opening paragraph is characterized in that said means are constructed for short-circuiting the current conductors upon the ocurrence of a defect of the outer bulb. The short-circuit preferably activates one or several fuses present in the lamp cap, so that switching-off of the lamp can take place in a reliable but safe manner, for example, through an interruption or melting of the fuse(s).

In a preferred embodiment of a lamp according to the invention, said means are at least substantially formed by a switch which is brought from an idle state into a short-circuit state upon fracture of the outer bulb. In particular, said switch is at least substantially formed by a resilient element which in the idle state rests against the inner surface of the outer bulb and which in the short-circuit state short-circuits the two current conductors. Preferably, the resilient element is already electrically connected to one of the current conductors when in the idle state.

In a further preferred embodiment of a lamp according to the invention, said resilient element is held under spring pressure in the idle state by means of an oxygen-binding, evaporating getter which releases the spring upon fracture of the outer bulb. This has the additional advantage that the lamp is also extinguished by the resilient element if the outer bulb does not break, but does show a hole, which means that the lamp nevertheless also forms a safety risk. The outer bulb will be gastight if such a getter is used.

In a further preferred embodiment of the lamp according to the invention, said switch is at least substantially formed by a resilient element which is brought from an idle state into a short-circuit state upon an impact load on the lamp. The switch preferably comprises a rod element which is electrically connected to one of the current conductors and a ring element which is electrically connected to the other current conductor, said rod element in the idle state being inside the ring of the ring element and making electrical contact with the ring in the short-circuit state through a lateral movement, thus short-circuiting the two current conductors. This arrangement results in a short circuit of the current conductors in the event of a force exerted on the lamp, irrespective of whether the outer bulb actually breaks, has a hole, or has a crack. In other words, any unacceptable force exerted on the lamp which involves a safety risk is detected and leads to switching-off of the lamp.

It is noted in this connection that the present invention has no limitation regarding the type of electric lamp, i.e. it may be implemented in a so-called tungsten halogen incandescent lamp as well as in a gas discharge lamp. The former type is, for example, a halogen incandescent lamp with bromine, chlorine, hydrogen, and also a rare gas and/or nitrogen as the filling gas, while the latter type may be, for example, a high-pressure mercury vapor discharge lamp. Although the outer bulb need not necessarily be gastight in the case of a halogen incandescent lamp, the safety risk described above is present in both types of lamps when the outer bulb is fractured. As was noted before, the present invention is accordingly applicable to both types.

The invention also relates to a method of manufacturing an electric lamp according to the invention, which method is characterized in that said means are constructed for short-circuiting the current conductors upon a defect of the outer bulb.

BRIEF DESCRIPTION OF THE DRAWING

The invention will now be explained in more detail with reference to a drawing, in which.

DETAILED DESCRIPTION

Figure 1:
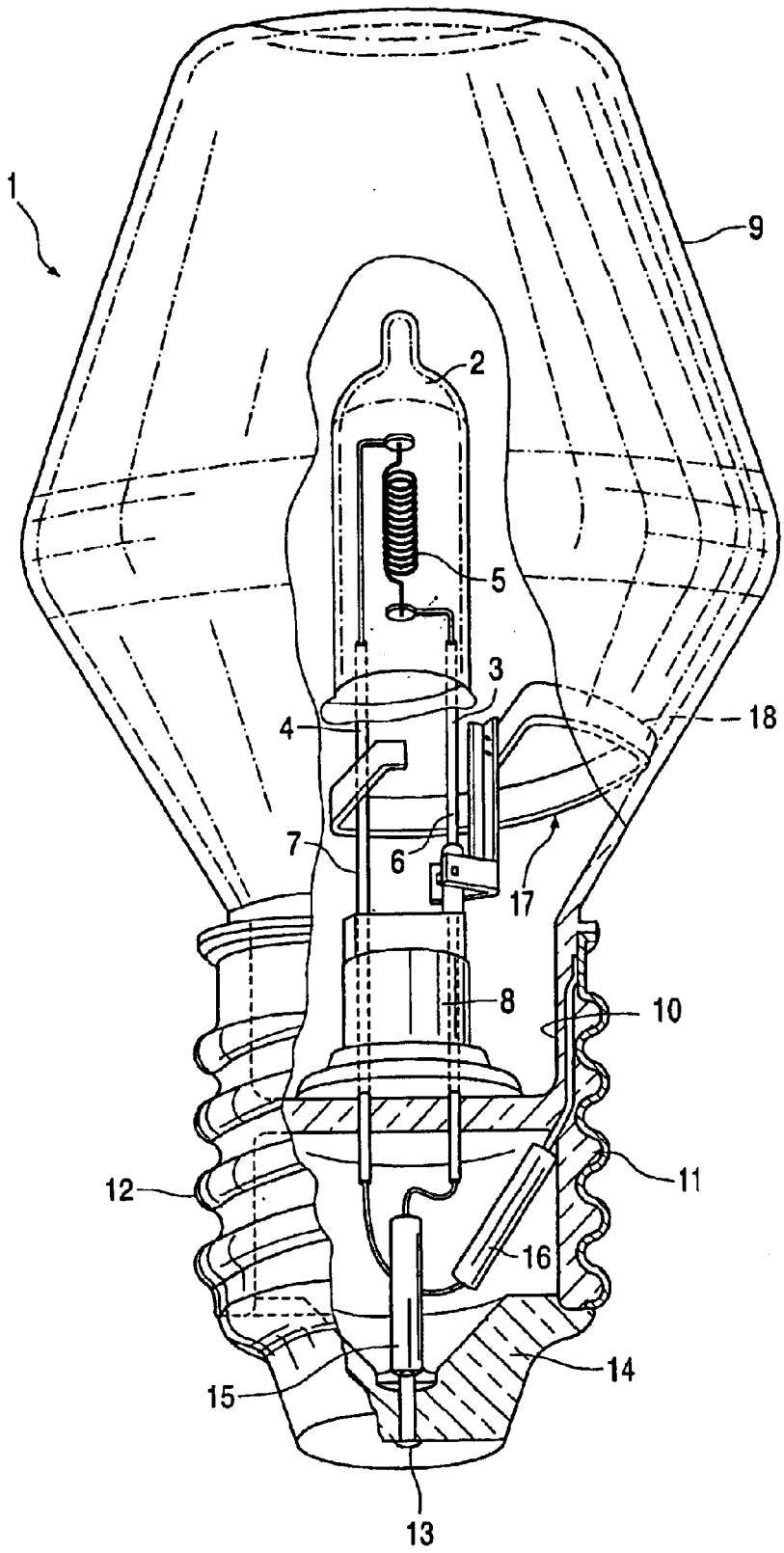
FIG. 1 is a partial longitudinal sectional view diagrammatically depicting a first preferred embodiment of a lamp according to the invention.

In FIG. 1, there is shown a halogen incandescent lamp 1 of the tungsten type, comprising a gastight inner bulb 2 with two current conductors 3, 4 having first ends which extend into the inner bulb 2 and support a tungsten filament 5, and having second ends which extend outside the inner bulb 2, where they are electrically connected to the current 30 conductors 6, 7 of a stem 8. The second ends are, for example, welded to the current conductors 6, 7 of the stem 8. The stem 8, which serves as a support, accordingly supports the inner bulb 2 in the lamp 1. The lamp 1 further comprises an outer bulb 9 of translucent material, for example transparent glass, arranged around the inner bulb 2, which outer bulb 9 has a neck portion 10 which is fastened to a lamp cap 11 of the lamp 1. The lamp cap 11 is provided with a first electrically conducting portion 12 which forms a traditional metal shell of the lamp 1 provided with a screw thread at its outer side, and with a second electrically conducting portion 13 which forms a conventional metal eyelet of the lamp 1. The two portions 12, 13 are separated and electrically insulated from one another in a usual manner by means of a traditional glass insulator 14. The current conductors 6, 7 of the stem 8 are connected at their lower sides with electrical conduction to the metal eyelet (current conductor 6) and the metal shell (current conductor 7), respectively, fuses 15, 16 being connected in series in the electrical circuit in the region of the lamp cap 11. It is noted that the lamp 1 usually has two fuses in accordance with European standards, as shown here, but often only one fuse in the USA.

In the first preferred embodiment shown in FIG. 1, a switch in the form of a resilient element 17 is fastened to the current conductor 6 with electrical conduction. The resilient element 17 in an idle state 18 (shown in broken lines) bears with spring pressure on the inner side of the outer bulb 9. If the outer bulb 9 should inadvertently be fractured, the resilient element 17 is released by the elimination of the counter pressure of the glass surface of the outer bulb 9 and will spring outward into a short-circuit position 19. In this latter position 19, the resilient element 17 makes electrical contact with the other current conductor 7, thus causing a short-circuit. This short-circuit will operate at least one of the fuses 15, 16, so that the lamp 1 is extinguished in a reliable and safe manner (FIG. 2).

Figure 2:
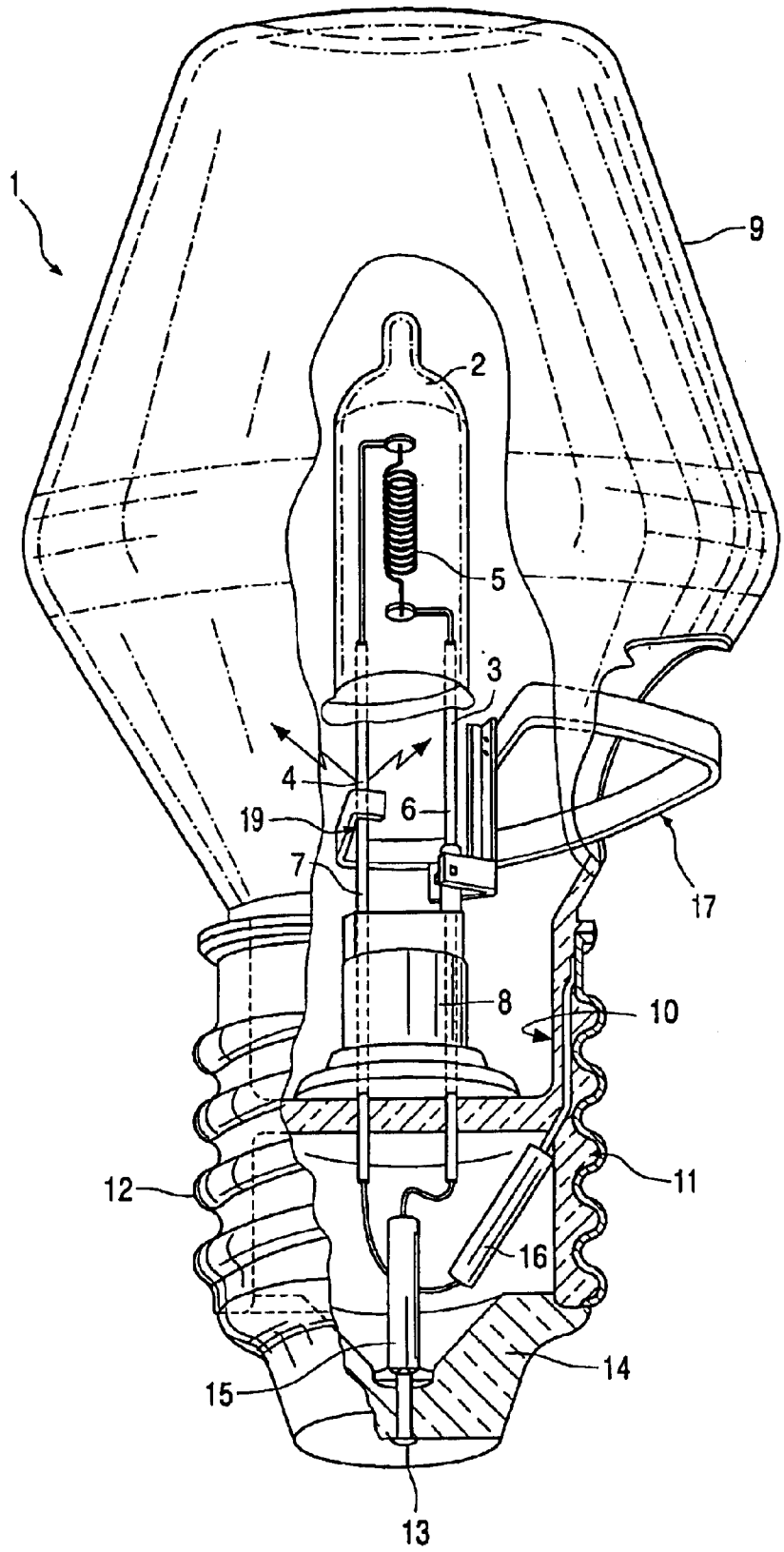
FIG. 2 is a view similar to FIG. 1, but with the outer bulb being fractured.
Figure 3:
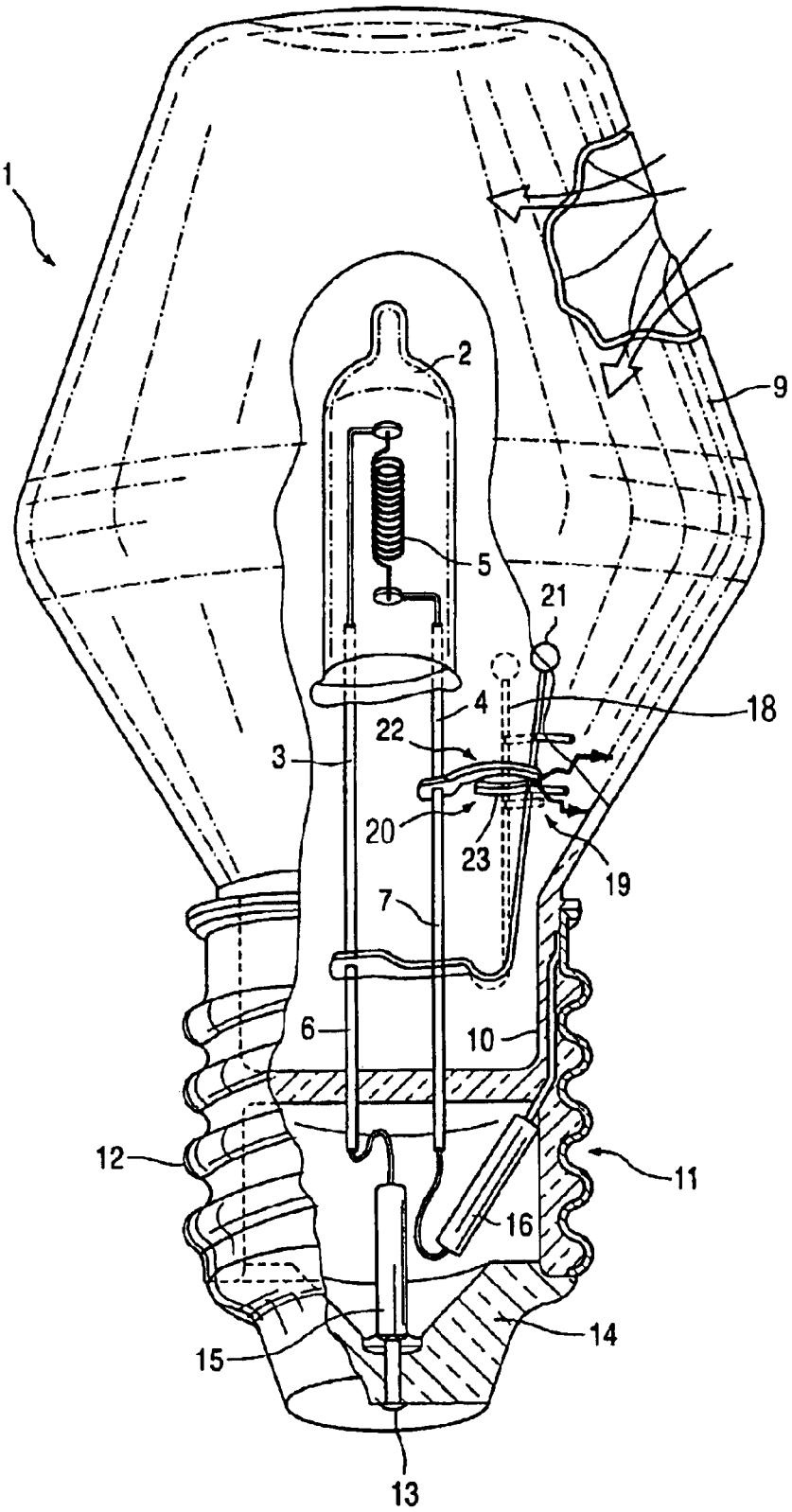
FIG. 3 is a partial longitudinal sectional view of a second preferred embodiment of a lamp according to the invention.

A second preferred embodiment is shown in FIG. 3, components corresponding to those in FIGS. 1 and 2 having been given the same reference numerals. The switch now has the form of a so-called tilting switch 20 comprising a resilient rod element 21 electrically connected to the current conductor 6 and a ring element 22 electrically connected to the current conductor 7. The rod element 21 in the idle state 18 (shown in broken lines) lies within the ring 23 of the ring element 22. Upon an impact load on the outer bulb 9, the rod element 21 will spring resiliently sideways into the short-circuit position 19, for example as a result of a force causing a fracture, thus making electrical contact with the ring 23 and short-circuiting the two current conductors 6, 7. This causes at least one of the two fuses 15, 16 to be operated, so that the lamp 1 is extinguished. The tilting switch 20 may indeed be used in combination with the resilient element 17.

The invention is not limited to the embodiments shown in the drawing, but also covers alternative embodiments within the scope of protection of the appended claims.

We claim:

1. An electric lamp comprising:

a gastight inner bulb for converting electrical energy into light, an outer bulb surrounding and spaced apart from the inner bulb, a lamp cap connected to the outer bulb, two current conductors extending outside of the inner bulb, carried by a support, and electrically connected to the lamp cap, and means for switching off the lamp in the case of a defect of the outer bulb, characterized in that said means are constructed for short-circuiting the current conductors upon a defect of the outer bulb.

2. An electric lamp as claimed in claim 1, wherein said means activate a fuse in the lamp in the case of a short-circuit.

3. An electric lamp as claimed in claim 1, wherein said means comprises a switch which is brought from an idle state into a short-circuit state upon fracture of the outer bulb.

4. An electric lamp as claimed in claim 3, wherein said switch comprises a resilient element which in the idle state rests against the inner surface of the outer bulb and which in the short-circuit state short-circuits the two current conductors.

5. An electric lamp as claimed in claim 4, wherein said resilient element is already electrically connected to one of the current conductors when in the idle state.

6. An electric lamp as claimed in claim 1, wherein said switch comprises a resilient element which is brought from an idle state into a short-circuit state upon an impact load on the lamp and preferably comprises a rod element which is electrically connected to one of the current conductors and a ring element which is electrically connected to the other current conductor, said rod element in the idle state being inside the ring of the ring element and making electrical contact with the ring in the short-circuit state through a lateral movement, thus short-circuiting the two current conductors.

7. An electric lamp as claimed in claim 1, wherein the lamp is of the tungsten halogen incandescent lamp type.

8. An electric lamp as claimed in claim 1, wherein the lamp is of the gas discharge lamp type.

9. A method of manufacturing an electric lamp, the lamp comprising:

a gastight inner bulb for converting electrical energy into light, which inner bulb comprises two current conductors extending to outside the inner bulb, an outer bulb provided around the inner bulb with an interspacing between the two, a lamp cap connected to the outer bulb, said current conductors of the inner bulb, aided by a support, being connected to the lamp cap with electrical conduction, and means constructed for switching off the lamp upon a defect of the outer bulb, the method characterized in that said means are constructed for short-circuiting the current conductors upon a defect of the outer bulb.

* * * * *